US007459397B2

(12) United States Patent
Washino et al.

(10) Patent No.: US 7,459,397 B2
(45) Date of Patent: Dec. 2, 2008

(54) POLISHING METHOD FOR SEMICONDUCTOR SUBSTRATE, AND POLISHING JIG USED THEREIN

(75) Inventors: Ryu Washino, Chigasaki (JP); Yasushi Sakuma, Tokyo (JP); Masaru Mukaikubo, Fujisawa (JP); Hura Harpreet Singh, Yokohama (JP); Kenji Uchida, Yokohama (JP)

(73) Assignee: OpNext Japan, Inc., Yokohama-shi (JP)

( * ) Notice: Subject to any disclaimer, the term of this patent is extended or adjusted under 35 U.S.C. 154(b) by 299 days.

(21) Appl. No.: 11/028,295

(22) Filed: Jan. 4, 2005

(65) Prior Publication Data

US 2005/0250334 A1 Nov. 10, 2005

(30) Foreign Application Priority Data

May 6, 2004 (JP) ..... 2004-137067

(51) Int. Cl.
*H01L 21/302* (2006.01)

(52) U.S. Cl. ..... 438/692; 451/285; 451/289

(58) Field of Classification Search ..... 438/692; 451/285, 289

See application file for complete search history.

(56) References Cited

U.S. PATENT DOCUMENTS

| | | | | |
|---|---|---|---|---|
| 5,472,566 | A * | 12/1995 | Swann et al. | 204/192.34 |
| 6,102,780 | A * | 8/2000 | Ishimaru | 451/41 |
| 6,517,422 | B2 | 2/2003 | Sakamoto et al. | |
| 2005/0087697 | A1 * | 4/2005 | Lee et al. | 250/440.11 |

FOREIGN PATENT DOCUMENTS

| | | |
|---|---|---|
| JP | 53-001464 | 1/1978 |
| JP | 61-158145 | 7/1986 |
| JP | 61-209878 | 9/1986 |
| JP | 03-129823 | 6/1991 |
| JP | 03-256668 | 11/1991 |
| JP | 04-305925 | 10/1992 |
| JP | 05-326468 | 12/1993 |
| JP | 06-335855 | 12/1994 |
| JP | 09-183063 | 7/1997 |
| JP | 10-230455 | 9/1998 |

(Continued)

OTHER PUBLICATIONS

Korean Official Action, for Application No. KR 10-2004-115867, dated Mar. 31, 2006.

(Continued)

*Primary Examiner*—Zandra Smith
*Assistant Examiner*—Colleen E Rodgers
(74) *Attorney, Agent, or Firm*—Antonelli, Terry, Stout & Kraus, LLP.

(57) ABSTRACT

During the polishing of a semiconductor substrate, the semiconductor wafer that has been reduced in thickness, and hence in strength, by polishing, suffers outer-surface damage (or cracking) due to the initial damage caused by the use of polishing quartz. In order to solve these problems, the present invention applies a semiconductor substrate fixing jig formed with, on the face for fixing the semiconductor substrate, a groove(s) of almost the same diameter as that of the semiconductor substrate. Semiconductor substrate damage and cracking can be suppressed by applying this jig.

9 Claims, 5 Drawing Sheets

FOREIGN PATENT DOCUMENTS

| | | |
|---|---|---|
| JP | 2001-105307 | 4/2001 |
| JP | 2001-257183 | 9/2001 |
| JP | 2003-158104 | 5/2003 |
| JP | 2003-285263 | 10/2003 |
| JP | 2004-071667 | 3/2004 |

OTHER PUBLICATIONS

Official Action, for Application No. 2004-137067, dated Sep. 19, 2006.

Official Action, for Application No. 2004-137067, dated Dec. 12, 2006.

Japanese Questioning for Application No. 2004-137067, dated Feb. 12, 2008.

Japanese Trial Decision dated Jun. 10, 2008, for Application No. 2004-137067.

* cited by examiner

POLISHING METHOD FOR SEMICONDUCTOR SUBSTRATE, AND POLISHING JIG USED THEREIN

CLAIM OF PRIORITY

The present application claims priority from Japanese application serial no. 2004-137067, filed on May 6, 2004, the content of which is hereby incorporated by reference into this application.

BACKGROUND OF THE INVENTION

The present invention relates to a method of polishing semiconductor substrates in such a manner as to prevent the semiconductor substrates from cracking, and to a polishing jig to be used in the polishing method.

In the field of semiconductor manufacture, during manufacturing processes, thick substrates typically undergo processing in order to prevent semiconductor substrates from cracking. After the formation of patterns, the reverse side of each substrate is polished for the thickness of the substrate to match specifications. During this polishing process, semiconductor substrates are fixed to circular quartz plates using wax. Each of the quartz plates is further mounted in the polishing holder used for applying a load to the semiconductor substrate. An alkali polishing liquid containing a polishing agent is supplied to the quartz-made polishing surface of a polishing apparatus, and the semiconductor substrate that has been pressed firmly against the polishing surface is polished.

The above process is described below using FIGS. 5A and 5B. FIGS. 5A, 5B are views that explain semiconductor substrate polishing based on a related technology. FIG. 5A is a plan view from a polishing surface, showing a quartz disc 120 to which the patterned face of a semiconductor substrate 103 is fixed using a wax 104, and a polishing holder 105 in which the quartz disc 120 is mounted. FIG. 5B is a sectional view that explains section IV-IV' of the polishing holder assembly 100 and quartz surface plate 107 when viewed during polishing. In FIG. 5A, notches 105*a* are provided in angle steps of 90 degrees in the polishing holder 105. In FIG. 5B, a polishing liquid 106 containing a polishing agent is supplied to the surface of the surface plate 107. The surface plate 107 is rotating around its rotation axis not shown, and the polishing holder 105 itself is also revolving on its axis by means of a rotating mechanism not shown, so the semiconductor substrate 103 is polished while revolving on its axis. Such polishing is a combination of chemical polishing with a polishing liquid, and mechanical polishing with a polishing agent, and this polishing scheme is called CMP (Chemical-Mechanical Polishing).

Japanese Patent Laid-Open No. 2004-71667 describes solutions to the following problems associated with the related technology, in perspectives different from those of the present invention:

A space exists at section A in FIG. 5B mentioned above in "Background of the Invention". During the initial phase of polishing, this space has the same height as the thickness of the substrate supplied to the wafer process. The polishing liquid 106, when supplied to section A, repeatedly melts the wax 104 between the semiconductor substrate 103 and the quartz disc 120, and as the wax 104 is consumed, it is thinned down and reduced in strength by polishing. As a result, the wax loses the fixing force and may permit the semiconductor substrate 103 to move slightly upward, thus damaging the outer surface of the substrate. The substrate is also prone to cracking, since it is in mechanical contact with the surface plate 107. During the processes that follow the polishing process, such cracking causes further damage to the semiconductor substrate or results in semiconductor chip damage.

SUMMARY OF THE INVENTION

In order to solve the above problem, the present invention provides a jig for fixing a semiconductor substrate, with a circular groove slightly larger than a diameter of the semiconductor substrate. The semiconductor substrate is fixed to this groove by means of wax. For the grooveless jig used in the related technology, the wax between the semiconductor substrate and the jig begins to melt and flow out with the start of polishing. In contrast to the related technology, the present invention provides a circular groove slightly larger than the diameter of the semiconductor substrate, the side of the semiconductor substrate that is fitted in the groove, therefore, is covered with the wax used for fixing the semiconductor substrate and the jig, and thus prevents the wax from melting and flowing out.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

In the embodiments below, gallium arsenide, a compound semiconductor, is described as an example of a semiconductor substrate material. Compared with silicon, the compound semiconductors used for photosemiconductor devices, such as gallium arsenide (GaAs), indium phosphor (InP), and gallium nitride (GaN), have the properties of low hardness and brittleness. Also, the process of polishing to satisfy thickness specifications is performed nearly at the end of wafer processing, so the polishing process enhances an added value of the wafer. For an optical module that uses photosemiconductors, since the other components assembled during subsequent processes are high in price ratio, great damages result if cracks become conspicuous during subsequent processes.

Embodiments of the present invention are described hereunder with reference to the accompanying drawings.

Figure 1A:
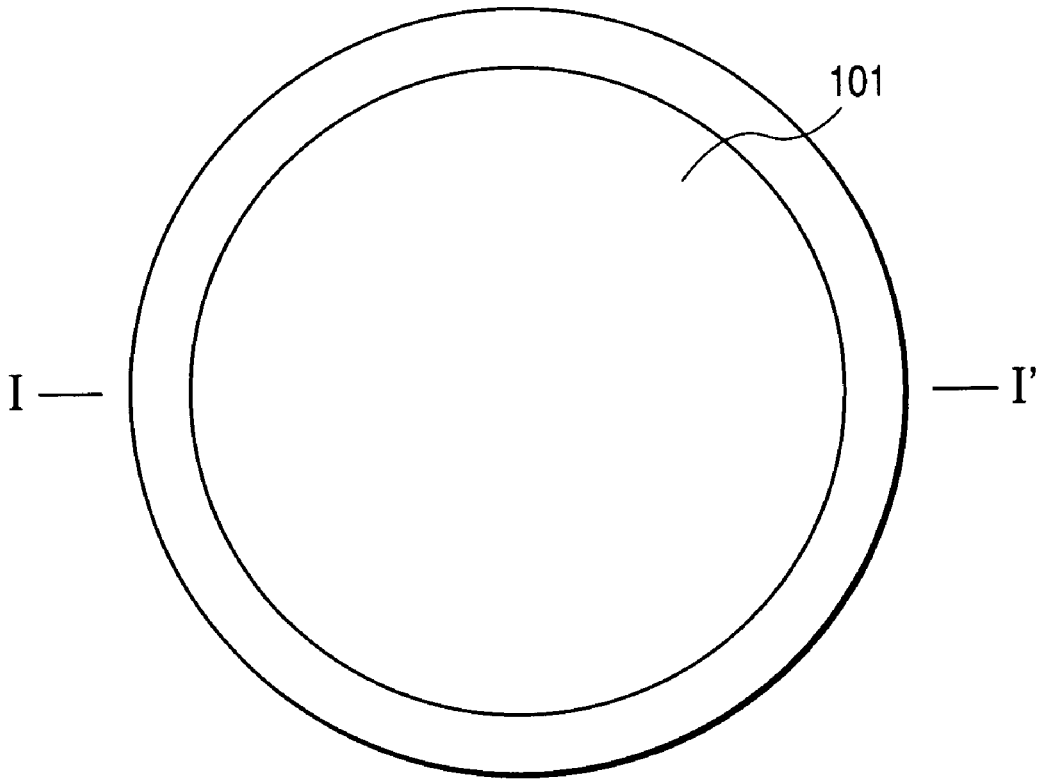
FIGS. 1A, 1B are views explaining an embodiment of a polishing jig according to the present invention.
Figure 1B:
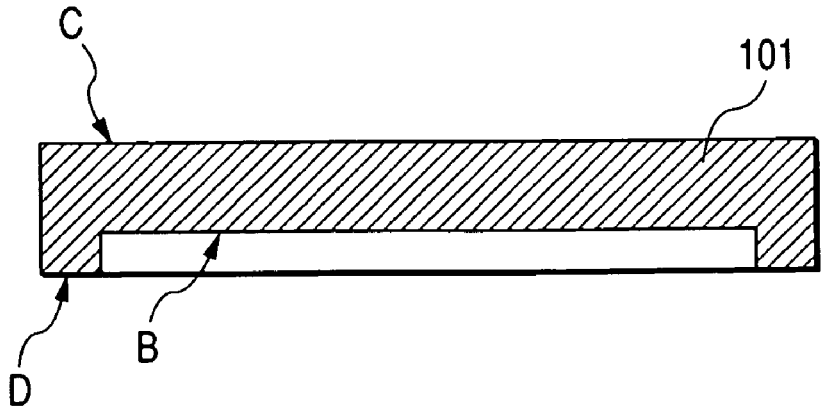
Figure 2A:
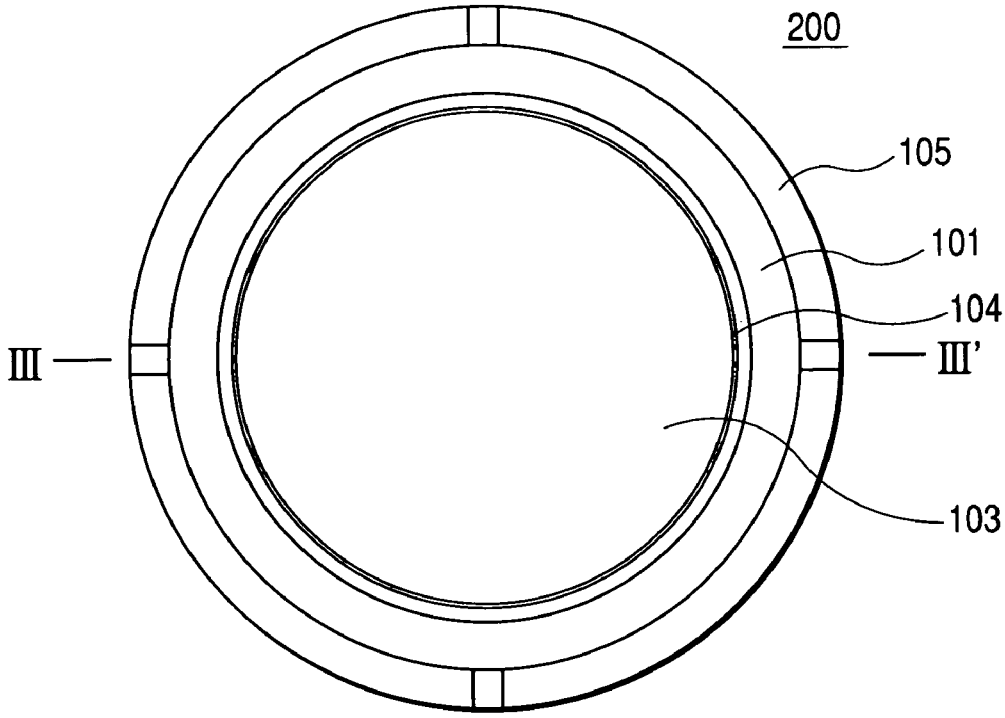
FIGS. 2A, 2B are views explaining an embodiment of a polishing process according to the present invention.
Figure 2B:
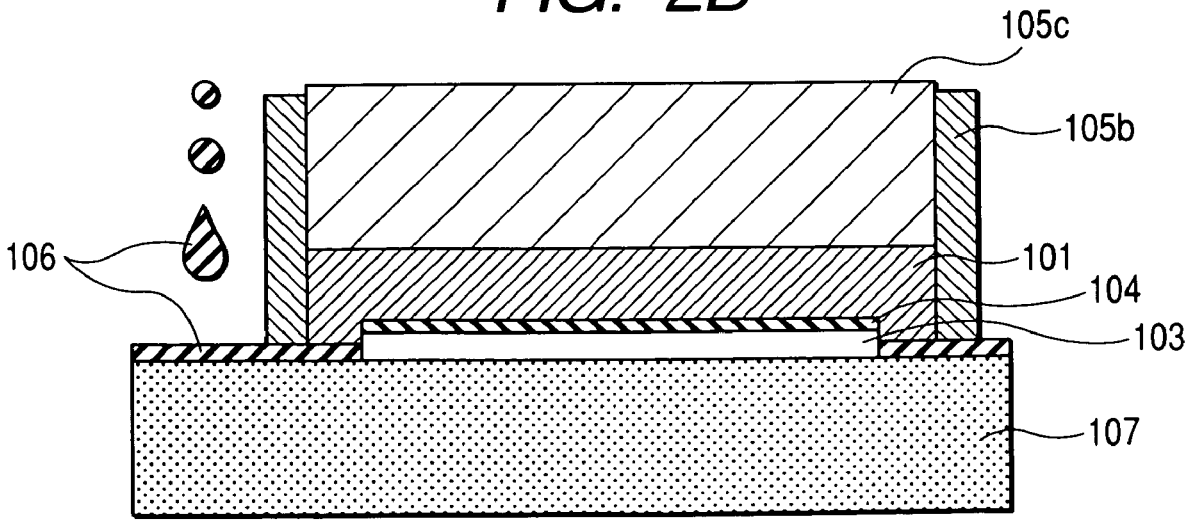

FIGS. 1A and 1B are views explaining an embodiment of a polishing jig according to the present invention. FIGS. 2A and 2B are views explaining an embodiment of a polishing process according to the present invention. A polishing jig formed of a quartz disc and having a groove with a depth of 100 micrometers (μm) and a diameter of 52.0 mm, on one face (face D) of the disc, is shown in FIGS. 1A, 1B. In this case, face B for attaching an object to be polished, and face C for applying a load while in contact with a polishing holder require highly accurate processing since flatness levels of faces B and C affect in-plane thickness nonuniformity of the object to be polished. The groove depth of 100 μm is given as a reference for compliance with after-polishing thickness specifications of 100±10 μm of the object to be polished. Therefore, since parallelism between faces D and B directly affects uniformity of thickness of the object to be polished, initial accuracy of the quartz material itself is also required.

Figure 5A:
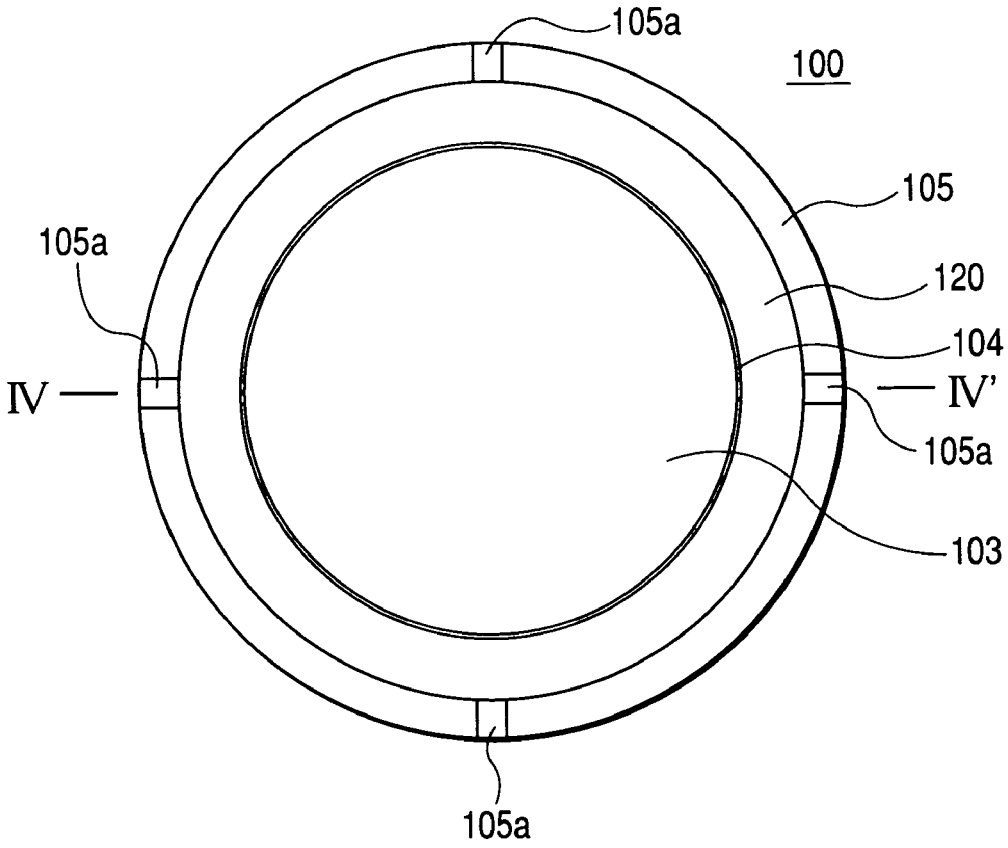
FIGS. 5A, 5B are views explaining the polishing process according to the related technology.
Figure 5B:
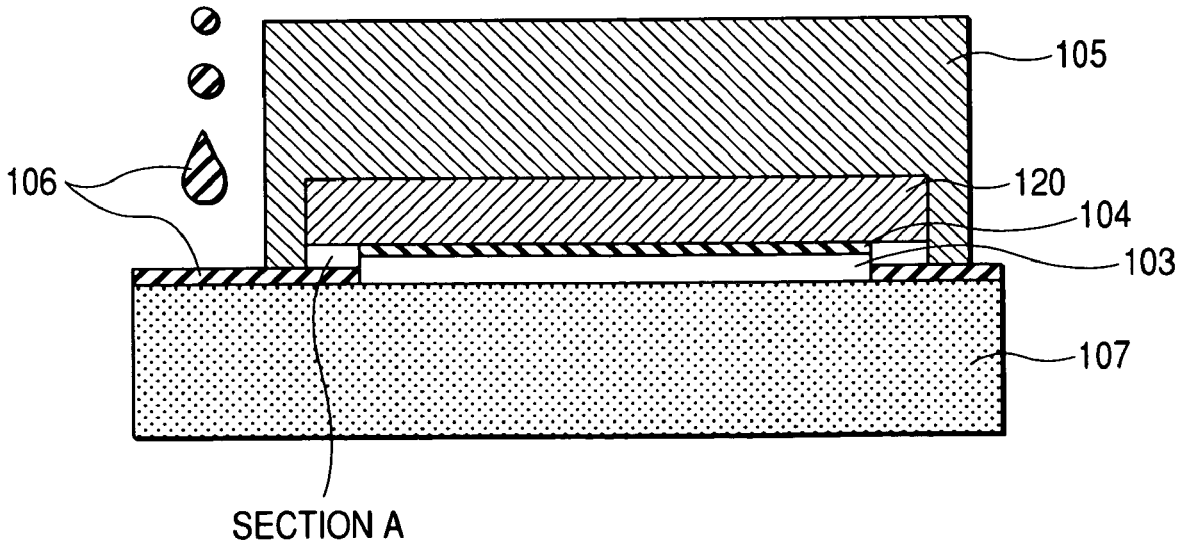

FIG. 2A is a plan view from a polishing surface, showing a quartz jig 101 with face B to which a patterned face of a gallium arsenide wafer 103 with a thickness of 350 μm and a diameter of 50.8 mm is fixed using a wax 104, and a polishing holder 105 in which the quartz jig 101 is mounted. FIG. 2B is a sectional view that explains section III-III' of a polishing holder assembly 200 and quartz surface plate 107 when viewed during polishing. The polishing holder 105, although shown as an integrated unit in FIG. 5B, is split into a polishing ring section 105*b* and a loading section 105*c*, in the present embodiment. In FIG. 2B, a polishing liquid 106 containing a polishing agent is supplied to the surface of the surface plate 107. The surface plate 107 is rotating around its rotation axis not shown, and the polishing holder 105 itself is also revolving on its axis by means of a rotating mechanism, so a reverse face (nonpatterned face) of the gallium arsenide wafer 103 is polished when the wafer is revolving on its axis. Also, a clearance between the quartz jig 101 and the loading section 105*c* is fixed by a suction pressure applied from a vacuum source not shown. The loading section 105*c* has a mass of 10 to 15 kg.

In the present embodiment, the diameter of the gallium arsenide wafer 103 is 50.8 mm and the diameter of the groove in the quartz jig is 52.0 mm, so that there is only a difference of 0.6 mm between both dimensions at one side. The wax 104 is liquefied by heat and then uniformly applied to a groove interior of the quartz jig so as not to generate bubbles. Next after the gallium arsenide wafer vacuum-chucked by vacuum tweezers has been mounted, the wafer is fixed by pressurizing and cooling the wax. An excess of the wax fills in an entire space equivalent to the differential diameter of 0.6 mm at one side. This prevents the the problem encountered in the related technology, namely, the melting and outflow of the wax between the semiconductor substrate and the quartz jig. Hence, it is possible to suppress the damage to the semiconductor substrate being polished, and its cracking likely to occur during polishing and to cause damage during subsequent processes.

The damaging and cracking are also suppressed since sidewalls of the groove work as walls in such a manner that they will prevent cracking of the semiconductor substrate thinned down by polishing.

Additionally, in the present embodiment, the polishing liquid selected polishes only gallium arsenide and does not polish quartz. The thickness of the semiconductor substrate can therefore be easily controlled by matching the groove depth of the quartz jig to thickness specifications of the substrate after being polished. More specifically, whether the semiconductor substrate has been polished to completion can be judged by confirming that the difference in diameter (in other words, a difference in level) between the gallium arsenide substrate and the polishing jig has disappeared. In the above-described embodiment, a thickness of the wax is ignored for simplicity of description. In actuality, however, the thickness cannot be ignored and the depth of the groove needs to equal the thickness specifications of the substrate plus the thickness of the wax.

Furthermore, since the quartz jig for fixing is formed with accurate flatness, it is possible to obtain semiconductor substrates substantially free from in-plane thickness nonuniformity and required to have highly accurate flatness. Substrate thickness specifications are determined by particular characteristics of optical elements and a layout design for element mounting in subsequent processes.

Experiments indicate that even if difference in the groove diameter of the quartz jig is about 5 mm for a maximum diameter tolerance of the semiconductor substrate, it is possible to fill in the groove section with wax (for a groove depth of 100 μm). Preferable difference, however, is 2 mm or less.

The wax here does not refer only to beeswax, and the wax can be any kind of wax, only if it is solid at room temperature and can be changed into a liquid of a low viscosity by applying heat.

Although a gallium arsenide wafer is exemplified as the semiconductor substrate in the above embodiment, the substrate may be any other different type of compound semiconductor substrate or may be a silicon wafer. Although a surface plate made of quartz is exemplified as the surface plate, this may be a polishing cloth. Although a quartz jig is exemplified as the jig for attaching the semiconductor substrate, the kind of material is of no matter, only if the material is corrosion-resistant against the polishing liquid used (i.e., only if the material is resistant to corrosion/polishing). For example, the material may be glass or a ceramic material.

Figure 3A:
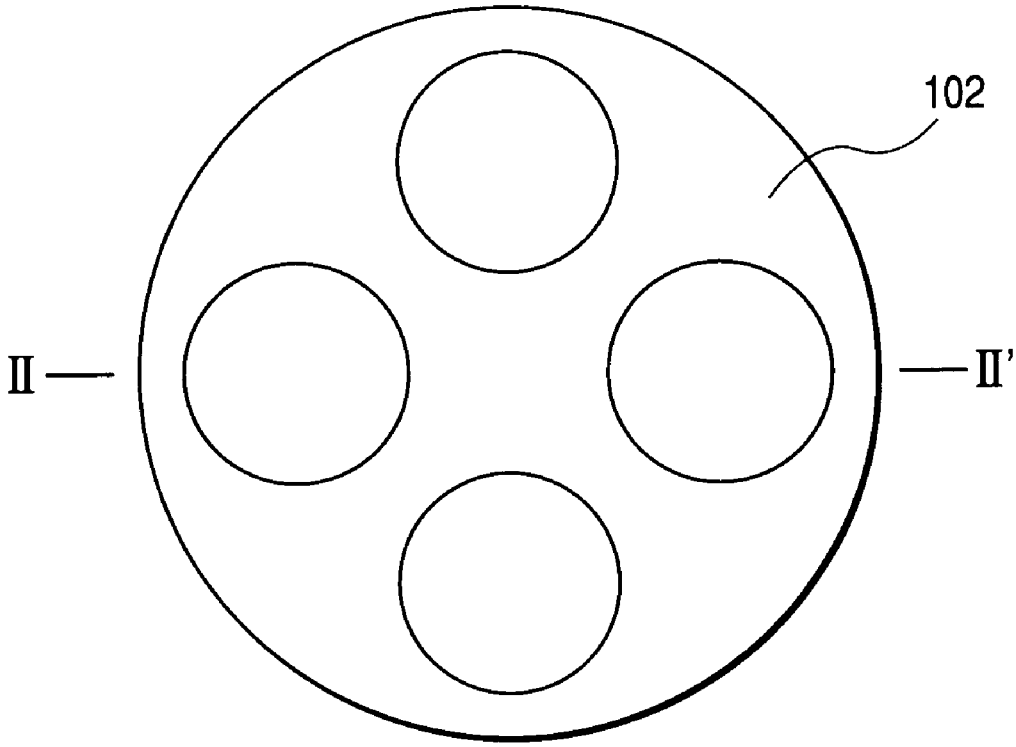
FIGS. 3A, 3B are views explaining another embodiment of a polishing jig according to the present invention.
Figure 3B:
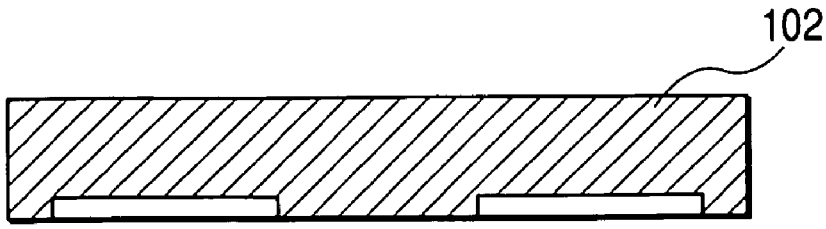

FIGS. 3A and 3B are views explaining yet another embodiment of a polishing jig according to the present invention. FIG. 3A shows a polishing jig having four grooves each with a depth of 100 μm and a diameter of 26.6 mm, on one face of a quartz disc. Four semiconductor substrates each with a diameter of 25.4 mm can be polished at a time using the quartz jig 102 in FIGS. 3A, 3B. Furthermore, it is possible to suppress the damage to the semiconductor substrate being polished, and its cracking likely to occur during polishing and to cause damage during subsequent processes.

Figure 4:
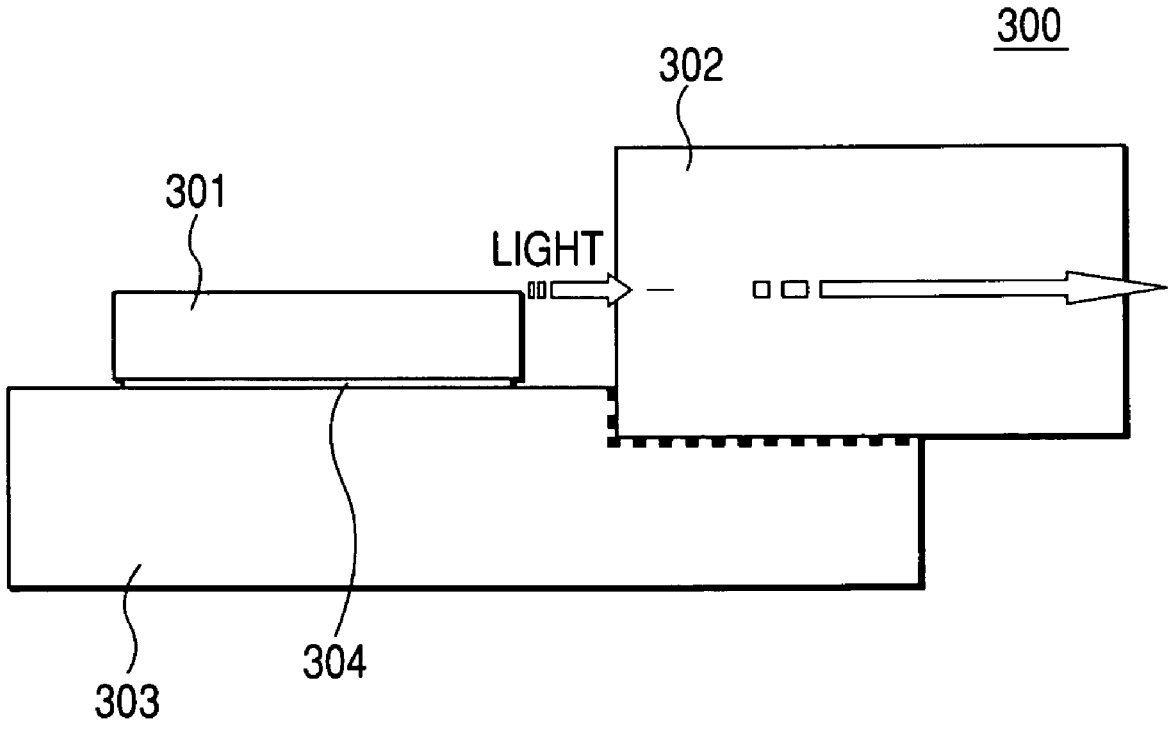
FIG. 4 is a schematic view of an optical transmission module embodying the present invention.

FIG. 4 is a schematic view of an optical module 300 on which is mounted a semiconductor device that applies the present invention. In FIG. 4, a gallium arsenide wafer with its reverse side polished using a manufacturing method according to the present invention is chipped into a laser diode 301 by undergoing reverse-side metalizing, cleaving, and/or the like. The laser diode 301 is then connected to a stem 303 via solder 304. A light-emitting position of the laser diode is present on the side of its patterned face, and light is conducted into optical fibers 302 through a lens not shown. A central position error of the optical fibers 302 needs to stay within ±3 μm of an oscillating position thereof, and a thickness tolerance of the laser diode 301 is set to ±10 μm to satisfy restrictions on a thickness of the solder (not shown) for fixing the optical fibers 302.

According to the present invention, since the wax for fixing the semiconductor substrate and the jig can be prevented from melting and flowing out, the cracks in the semiconductor substrate can also be prevented without damaging its outer surface.

We claim:

1. A method for polishing a semiconductor wafer, said method including the steps of:

fixing, by use of wax, a patterned face of said semiconductor wafer to a groove in a polishing jig having corrosion resistance to a polishing slurry, said groove having a diameter greater than a diameter of said semiconductor wafer by a maximum of 5 mm, covering an entire side surface of said semiconductor wafer in said groove with said wax by filling between said semiconductor wafer and said groove with said wax; and moving a nonpatterned face of said semiconductor wafer along the surface of a surface plate while said semiconductor wafer is in a pressed condition against said surface plate to which said polishing slurry is supplied.

2. The polishing method according to claim 1, wherein the diameter of said groove in said polishing jig is greater than the diameter of the semiconductor wafer by a maximum of 2 mm.

3. The polishing method according to claim 1, wherein said semiconductor wafer is a compound semiconductor wafer.

4. The polishing method according to claim 1, wherein said method includes fixing, by use of wax, said semiconductor wafer to a corrosion-resistant polishing jig having a groove whose diameter is greater than the diameter of said semiconductor wafer; and controlling an after-polishing thickness of said semiconductor wafer according to a depth of said groove.

5. The polishing method according to claim 4, wherein the depth of said groove is substantially equal to a sum of after-polishing thickness specifications of said semiconductor wafer and a thickness of said wax.

6. The polishing method according to claim 4, wherein whether polishing has been completed is judged by a differential height between said semiconductor wafer and said polishing jig.

7. The polishing method according to claim 1, wherein said semiconductor wafer is made of a material selected from the group consisting of GaAs, InP, and GaN.

8. The polishing method according to claim 1, wherein an entire space between the side surface of said semiconductor wafer and a side surface of said groove is filled with the wax.

9. The polishing method according to claim 1, wherein said covering said side surface of the semiconductor wafer sufficiently covers said side surface so as to restrict cracking of said semiconductor wafer during polishing.

* * * * *